US005486383A

United States Patent [19]

Nowotarski et al.

[11] Patent Number: 5,486,383

[45] Date of Patent: Jan. 23, 1996

[54] LAMINAR FLOW SHIELDING OF FLUID JET

[75] Inventors: Mark S. Nowotarski, Stamford, Conn.; Don J. Lemen, Indianapolis, Ind.; William J. Snyder, Ossining, N.Y.; David B. Leturno, Hoover, Ala.

[73] Assignee: Praxair Technology, Inc., Danbury, Conn.

[21] Appl. No.: 286,200

[22] Filed: Aug. 8, 1994

[51] Int. Cl.[6] ..... B05D 3/06

[52] U.S. Cl. ..... 427/446; 427/455; 239/291; 239/421; 239/422; 219/121.55; 219/121.33; 219/121.51

[58] Field of Search ..... 427/446, 447, 427/450, 451, 452, 453, 454, 455, 456; 239/290, 291, 296, 421, 422, 426, 85, 81; 219/121.55, 121.51, 121.33, 121.84

[56] References Cited

U.S. PATENT DOCUMENTS

| | | | |
|---|---|---|---|
| Re. 31,018 | 8/1982 | Harrington et al. | 219/121 PL |
| 3,179,783 | 4/1965 | Johnson | 219/76 |
| 3,470,347 | 9/1969 | Jackson | 219/76 |
| 3,900,639 | 8/1975 | Lauterbach | 427/34 |
| 4,121,082 | 10/1978 | Harrington et al. | 219/76 |
| 4,527,718 | 7/1985 | Kingston | 222/603 |
| 4,823,680 | 4/1989 | Nowotarski | 98/36 |
| 4,869,936 | 9/1989 | Moskowitz et al. | 427/423 |
| 4,992,337 | 2/1991 | Kaiser et al. | 428/642 |
| 5,132,512 | 7/1992 | Sanders et al. | 219/121.51 |
| 5,151,308 | 9/1992 | Moskowitz et al. | 428/35.8 |
| 5,154,354 | 10/1992 | Reiter | 239/299 |
| 5,195,888 | 3/1993 | Sharma et al. | 432/64 |
| 5,220,150 | 6/1993 | Pfender et al. | 219/121.51 |
| 5,285,967 | 2/1994 | Weidman | 239/80 |

OTHER PUBLICATIONS

*Journal of Fluid Mechanics*, No. 10, "Measurements of entrainment by axisymmetrical turbulent jets", F. P. Ricou and D. B. Spalding, pp. 21–32, 1961 No Month.

*Metallurgical Transactions* A, vol. 17A, Apr. 1986 Rodger Bricknell "The structure and properties of a nickel–base superalloy produced by osprey atomization–deposition".

*Primary Examiner*—Marianne Padgett

*Attorney, Agent, or Firm*—Chung K. Pak; Douglas E. Denninger

[57] ABSTRACT

A process and system for shielding a turbulent fluid stream, comprising emitting a laminar flow of a shielding gas transversely to the flow direction of the turbulent fluid stream preferably from a porous wall. The turbulent fluid stream may be hot and may contain a coating material. By projecting or directing the turbulent fluid stream at the surface of a substrate to be coated, the heated coating material is deposited on the surface of the substrate.

19 Claims, 2 Drawing Sheets

LAMINAR FLOW SHIELDING OF FLUID JET

FIELD OF THE INVENTION

The invention relates to fluid shielding methods and apparatuses which are useful for various industrial applications, such as plasma spray deposition.

BACKGROUND OF THE INVENTION

Fluid streams are often shielded from their surrounding environments to prevent contamination in many industrial processes. The shielding is normally carried out by surrounding the fluid streams with a shielding fluid, such as an inert gas. The shielding fluid, in turn, prevents reactive gases, such as oxygen, in the fluid streams' surrounding environments from infiltrating into the fluid streams.

U.S. Pat. No. 3,470,347 discloses a method for producing a substantially oxygen-free coating on a substrate by the use of a plasma arc coating torch. The torch produces an arc plasma through a constricting nozzle orifice so as to provide a high velocity, high energy arc effluent which carries coating materials to be deposited onto the substrate. The effluent is protected from its surrounding environment by surrounding it with a uniform turbulent flow of a coaxial annular shielding gas stream having a certain width and a certain forward momentum. The coaxial annular shielding gas stream, however, can only protect the effluent containing coating materials for a short distance. When the substrate to be coated is located too far from the torch, the coating materials in the effluent are oxidized before they are deposited on the substrate. Moreover, such a coaxial annular shielding stream according to U.S. Pat. No. 5,154,354 is susceptible to disruption by local cross winds. Disruption of the flow of the shielding gas allows air to infiltrate into the effluent and to oxidize the coating materials therein to cause an unsatisfactory quality of coating. In addition, this coaxial flow of the shielding gas does not block the ultra violet light given out by the effluent (plasma stream). The ultra violet light can cause blindness and produce ozone in the ambient air. Furthermore, this shielding arrangement is not effective for certain plasma deposition applications. For example, a low temperature melting material, such as plastic powder, may be used to coat a substrate. This material needs to be blown into the effluent of the torch through a tube as the effluent emerges from the nozzle in order to prevent overheating of the material. However, blowing the material, as well as the tube, disrupts and/or blocks the flow of the coaxial annular shielding gas and causes the effluent to be unprotected.

U.S. Pat. No. 4,869,936 discloses a method for shielding a particle-carrying high velocity oxyfuel flame stream. The shielding method involves ejecting the particle-carrying high velocity oxyfuel flame stream into a shielding cylinder and using a plurality of nozzles to produce a high velocity tangential flow around the particle-carrying high velocity oxyfuel flame stream within the shielding cylinder. The shielding cylinder, however, may fail after a short period of operation due to the combination of high temperature and high gas velocity. This may necessitate frequent shut downs to replace the shielding cylinder.

U.S. Pat. No. 4,992,337 discloses an electric arc spray process for the deposition of reactive metals. The reactive metals are sprayed from the electric arc with compressed inert atomizing gases. The sprayed reactive metals, however, would be rapidly mixed with air and would experience some oxidation before being deposited on a substrate. This process is not effective for shielding, among other things, plasma arc sprays, gas atomization of molten metals or high velocity oxyfuel flame streams.

Accordingly, it is an object of the invention to provide systems and processes for shielding turbulent fluid effectively in an efficient manner.

It is another object of the invention to provide systems and processes useful for blocking most of the ultra violet light given off by very high temperature turbulent gas streams.

It is yet another object of the invention to provide systems and processes for effectively depositing coating materials on different size substrates located at various distances from a torch or a nozzle for ejecting a turbulent fluid stream.

It is an additional object of the invention to provide shielding systems which can be retrofitted easily on existing spray devices, without any water cooling or other external cooling.

It is a further object of the invention to provide shielding systems that can be used with a tube or other solid objects which is located downstream of a turbulent fluid stream.

SUMMARY OF THE INVENTION

According to one embodiment of the present invention, the above objectives and other objectives apparent to those skilled in the art are achieved by a process for shielding a fluid containing stream from its surrounding environment, said process comprising:

(a) ejecting a turbulent flow of said fluid containing stream from at least one opening;

(b) emitting a laminar flow of a shielding fluid transversely to the flowing direction of said turbulent flow of said fluid containing stream; and (c) entraining said shielding fluid in said turbulent flow of said fluid containing stream to prevent infiltration of gas and/or vapor from said fluid containing stream's surrounding environment. The fluid containing stream may be provided with coating materials before or after being ejected from said at least one opening. The fluid containing stream carrying the coating materials may be preheated to melt the coating materials and then is directed to a substrate to deposit the coating materials on the substrate.

According to another embodiment of the present invention, the above objectives and other objectives apparent to those skilled in art are achieved by a fluid shielding system comprising:

(a) an elongated hollow body having a plenum, at least one inlet for introducing shielding fluid into said plenum and a porous diffusing surface for emitting shielding fluid in said plenum, said porous diffusing surface defining at least part of a passageway so that said porous diffusing surface can emit shielding fluid transversely or perpendicularly to the axis of said passageway;

(b) at least one source containing shielding fluid in communication with said at least one inlet of said elongated hollow body;

(c) at least one nozzle having at least one opening for ejecting a turbulent flow of a fluid containing stream into said passageway; and (d) mounting means for mounting said at least one nozzle having said at least one opening to direct said at least opening in the direction of said passageway.

As used herein the term "laminar flow" means root means square of velocity fluctuations that are less than 0.1 times average velocity.

As used herein the term "turbulent flow" means root means square of velocity fluctuations that are greater than 0.1 times average velocity.

As used herein the term "plenum" means an enclosed chamber for distributing gases.

DETAILED DESCRIPTION OF THE INVENTION

Figure 1:
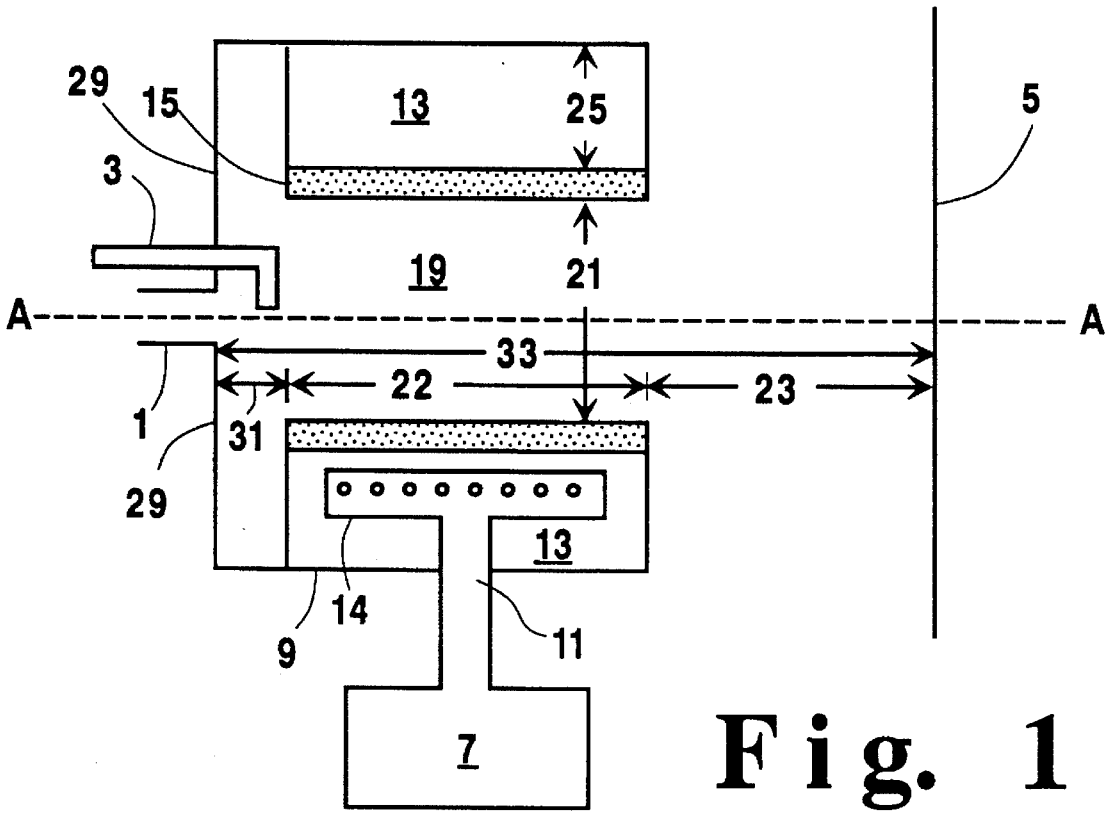
FIGS. 1, 2 and 3 show cross-sectional views of preferred embodiments of the invention, which are useful for shielding a turbulent fluid with inert gas.
Figure 2:
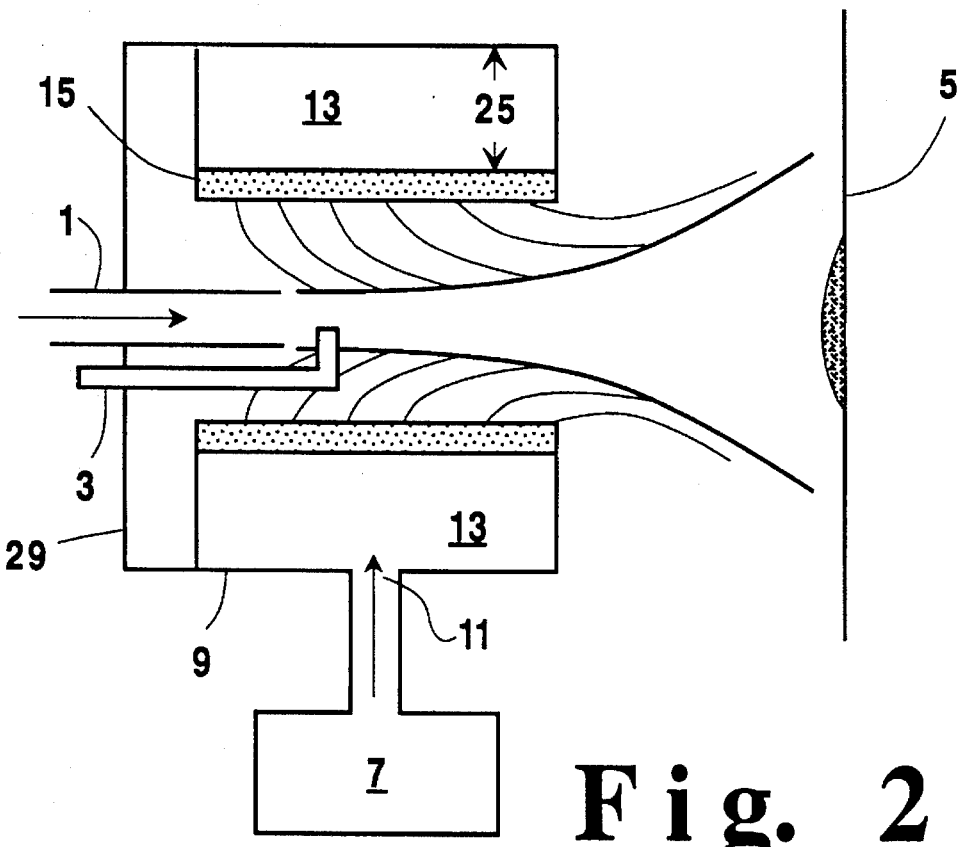

The present invention is described in detail in reference to the drawing.

Referring to the drawings, a turbulent flow of a fluid containing stream, hereinafter referred to as a turbulent stream, is ejected from at least on nozzle having at least one opening. The turbulent stream (1*a*) may be formed from any liquid or gaseous stream including an inert gas. The turbulent stream may be heated, e.g., heated to about 1000° C. to about 10,000° C. as in the case of plasma spray deposition. The heated turbulent stream may be obtained from known thermal spray processes that use chemical combustion or electric arc heating to generate heat. Some chemical combustion thermal spraying techniques include powder flame spraying, wire/rod flame spraying and detonation/explosive spraying. Some electric heating thermal spraying techniques include wire arc spraying and plasma arc spraying. In plasma arc spraying, an inert gas, such as argon, is subject to an electric arc and then is ejected from at least one nozzle (1) to produce a high temperature turbulent stream, e.g., a turbulent stream at a temperature of about 10,000° C. The turbulent stream can be, among other things, electric arc streams, plasma arc streams, flame streams (oxy-fuel or air-fuel flame), effluent from flames, molten droplets streams (liquid spray streams produced by pressure or gas atomization) and other streams containing particles or droplets.

Coating materials may be introduced into a hot turbulent stream after or before the hot turbulent stream is ejected from the nozzle (1). The coating materials may be in the form of powder, wire, or rod depending on the particular process. Often, the coating materials are in powder form and are introduced into the hot turbulent stream through a conveying means (3), such as at least one tube, with a powder conveying gas. As the coating materials are introduced into the hot turbulent stream, they are entrained in the turbulent stream and are heated to a softened or molten state. If the coating materials are introduced in the form of wire or rod, the coating materials are atomized. The molten or softened coating material confined or entrained within the turbulent stream is then directed at a substrate (5) to deposit the coating, materials. The coating material may be selected from, among other things, plastics, metals, alloys, oxides, ceramics, hard intermetallic and metallic compounds and certain glasses. The type of powder materials used varies depending on the desired coating characteristics.

Shielding fluid is delivered from a source (7) to an elongated hollow body (9). The elongated hollow body has at least one inlet (11) for receiving the shielding fluid, at least one plenum (13) for distributing the shielding fluid and at least one porous diffusing wall (15) for emitting the shielding fluid. The delivered shielding fluid enters the plenum (13) through the inlet (11) and leaves the plenum (13) through at least one porous wall (15) to produce an effective laminar flow. The formation of the laminar flow is promoted by using the plenum (13) having the desired depth (25), e.g., ⅛ inch, or more and the porous wall (15) having a well distributed plurality of pores having a diameter in the range of about 0.2 to about 1000 micron, preferably about 2 to about 20 micron. The plenum (13) is deep enough to attain a fairly uniform distribution of gas through the porous internal wall (15) which in turn allows it to emit an effective laminar flow from the well or uniformly distributed plurality of pores. Other gas distributing means, such as a screen, may also be used to produce a laminar flow even though they may be less effective. The laminar flow of the shielding fluid is directed transversely to the flowing direction of the turbulent stream. By providing the laminar flow of the shielding fluid transversely, the shielding fluid is effectively entrained and distributed along the length of the turbulent stream as the turbulent stream flows toward a desired point, e.g., a substrate to be coated (5). The effective entrainment and distribution of the shielding fluid along the length of the turbulent stream minimizes the oxidation or contamination or degradation of materials, such as powder, droplets and/or particles, within the turbulent stream since, reactive gases, such as oxygen, in the turbulent stream's surrounding environment is prevented or substantially prevented from being entrained in the turbulent gas. Normally, the amount of the shielding fluid used is such that the oxygen level or other reactive gas levels at the point of the impact, e.g., the surface of a substrate to be coated (5), is less than 1%, preferably less than 0.01%. The laminar flow of the shielding fluid is provided at a point near where the turbulent stream is ejected, e.g., within 2 inches from a point where the turbulent stream is ejected, so that the shielding fluid is well distributed along the length of the turbulent stream. The shielding fluid is an inert fluid, such as nitrogen, argon, hydrogen or mixtures thereof. The inert fluid, such as nitrogen, may contain up to 5% by volume oxygen. Such inert fluid can be obtained from a pressure or temperature swing adsorption system or a membrane gas separation system.

The porous diffusing wall (15) may be made with any solid material. Some of the materials useful for making the porous diffusing surface include sintered alloy, ceramic particles, ceramic cloth, metal particles, plastic particles, stainless steel particles. The type of materials used to construct the porous diffusing wall (15) normally varies depending on the particular process involved, i.e., the end usage. However, an oxidation resisting material, e.g., stainless steel, is generally preferred as a constructing material for the porous diffusing surface especially if it is to be used in high temperature coating, e.g., plasma coating. The porous diffusing surface has both porosity and thickness sufficient to provide a pressure drop of about 1 to 10 psig with the shielding gas flowing in order to ensure uniform distribution of shielding gas. This pressure drop is also found to allow the shielding gas to cool the porous diffusing surface, e.g., reduce overheating caused by a hot plasma stream, and minimize the deposition of stray particles, or metal or chemical vapor from the turbulent stream on the porous diffusing surface. Deposition of the straying particles or vapors can be further minimized if a screen means, e.g., stainless steel screens having openings having a crosssectional area of about 1 mm to about 10 mm, is used to cover and protect the porous diffusing surface.

Figure 3:
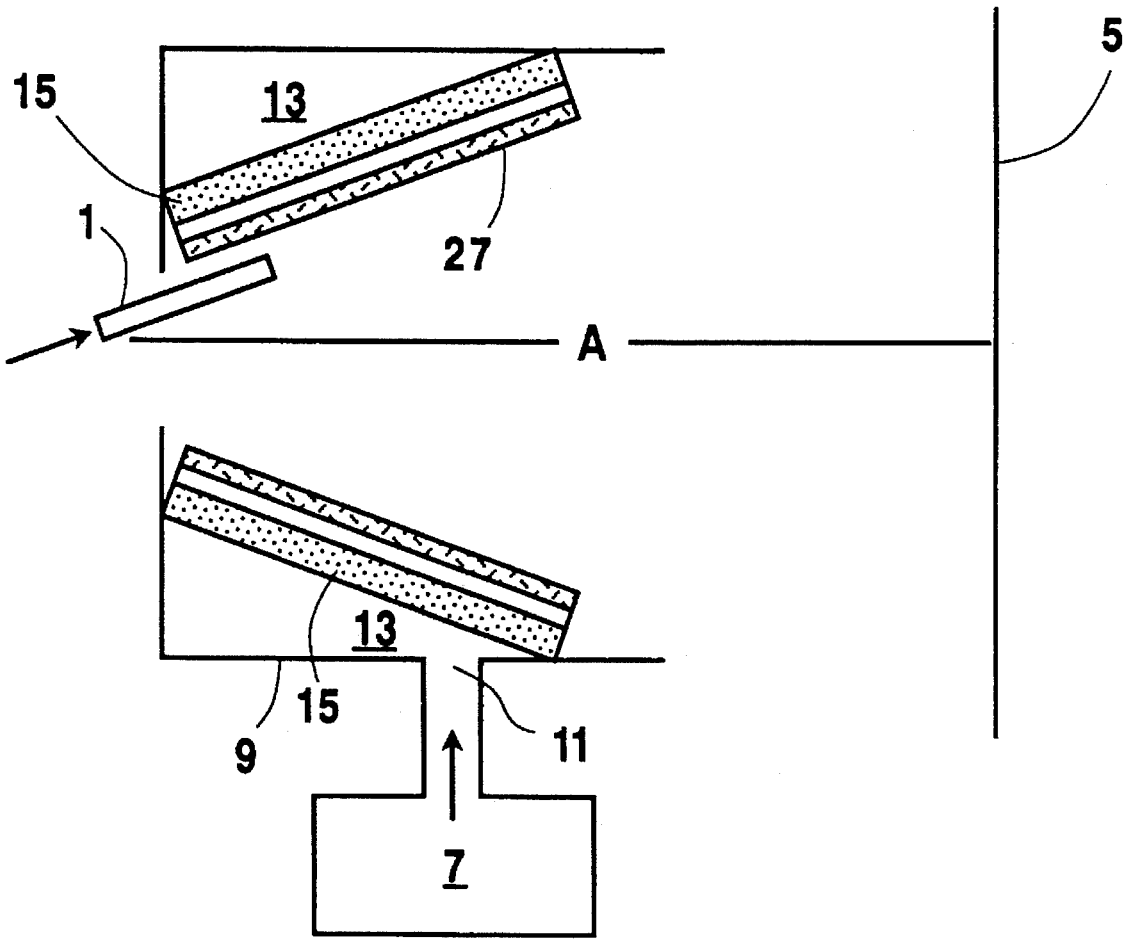

The shape of the outer surface (17) of the porous diffusing wall (15) may be such that the shielding fluid is emitted transversely to the turbulent stream. The outer porous diffusing surface (17) may define a passageway (19) having various shapes and sizes to allow the shielding fluid to flow transversely or perpendicularly to the axis (A) of the passageway (19). The outer surface (17) of the porous diffusing wall (15), however, need not define the entire passageway; it may define only part or at least part of the passageway that can be used to surround at least a portion of the length of the turbulent stream. It is, of course, most desirable to provide the outer surface of the porous diffusing wall (15) defining a cylindrical passageway or a diverging conical passageway so that the turbulent stream passing therethrough is shielded effectively from all sides with the transversely emitted shielding fluid. The length (22) of the passageway (19) may vary from one particular process to another, i.e., depending on the desired objective. The preferred length is normally equal to or greater than ¼ of the radius of the passageway (19) in the case of the cylindrical passageway. The most preferred length, however, is equal to or greater than the radius of the passageway (19). The passageway formed by at least in part by the porous outer surface (17) of the diffusing wall (15) does not materially affect the ejection angle of the turbulent stream. Even when the diverging conical passageway shown in FIG. 3 is formed, the turbulent stream can be ejected at an angle in the range of about 0° to about ±70°, measured from the axis (A) of the passageway. In fact, the porous diffusing surface in the form of a passageway is, not only proven to be useful for providing the desired shielding fluid flow in a desired direction, but also proven to be useful for blocking a large fraction of the ultra violet lights given off by certain turbulent streams, e.g. plasma arc streams. However, it should be understood that the outer surface of the porous diffusing wall need not form a passageway or need not be part of a passageway to surround the turbulent stream with the shielding fluid. As long as the laminar flow of the shielding fluid can be emitted transversely from an appropriate location to the flowing direction of the turbulent stream, the turbulent stream can be reasonably effectively shielded.

The following examples serve to illustrate the invention. They are not intended to be limiting.

EXAMPLE 1

The system illustrated in FIG. 1 was used to carry out a shielding process. A gas stream having 90% argon and 10% hydrogen flowing at about 100 normal cubic feet per hour was subjected to a 30 kilowatt electric arc to form a turbulent plasma stream. The turbulent plasma stream was ejected from a nozzle (1). The nozzle (1) has an opening or orifice which diameter is about 0.25 inch. The cylindrical passageway (19) defined by the outer surface (17) of the porous diffusing wall (15) has a diameter (21) of about 5 inches. It is preferred that the diameter (21) be larger than or equal to ¼ of a plenum standoff distance (23), i.e., a distance between the outlet end of the passageway and a target or a substrate (5), to ensure that the turbulent plasma stream will remain inert until it strikes the target or substrate (5). However, the diameter (21) is normally not critical. It can be as large as convenient. The depth (25) of the plenum (13) was 2 inches. This depth (25), however, can be reduced to as small as ⅛ inch and still can obtain good performance. A small depth can be important in reducing the size and weight associated with the plenum (13). The plenum (13) need only be deep enough to attain a fairly uniform distribution of gas through the porous wall(15). Internal baffles may also be provided to make the distribution of shield gas more uniform. The length (22) of the plenum was about 3 inches. It is preferably at least as long as ⅛ of the diameter (21) of the passageway (19). For smaller lengths, air is entrained into in the shielding gas flow prior the shielding gas flow being entrained into the turbulent jet. There is no upper limit on the length (22) of the plenum (13). The porous wall (15) had a thickness of about 0.062 inch and a porosity (a pore diameter) of about 2 microns. A thicker porous wall will have greater mechanical strength but a higher pressure drop. A larger porosity wall has a lower pressure drop, but might have a less uniform distribution of gas flow through it. Porosities as large as 100 microns have been used successfully. A wire mesh screen (27) is suitable if the shielding gas is distributed uniformly within the plenum (13) by gas distributing means such as a porous tube (14). A removable wire mesh screen (27) can be placed on the outer surface of the porous wall (15) to help prevent metal splatter from adhering to the porous wall (15). If the wire mesh (27) becomes plugged, it is easily removed and replaced. The porous wall was made of stainless steel, such as those sold under the tradename "316 stainless steel". It is, however, understood that other materials, such as metal alloys, ceramics, ceramic cloths and even plastics, can be used, depending upon the specific application. The nozzle (1) was sealed to the plenum (13) with a metal cover (29). This cover improves performance by helping to prevent air entrainment in the initial portion of the turbulent jet. It, however, is not required. The distance (31) from the opening of the nozzle (1) to the closest end of the plenum (13) was about 1.5 inches. This distance (31) is preferably less than 4 times the diameter (21) of the passageway (19) to prevent recirculation of the turbulent stream heating of the metal cover (29). The distance (31) is most preferably between 0.5 times the porous wall diameter and −0.5 times the length (22) of the porous wall (15) to prevent heating of the metal cover (29) by radiation from the plasma. When no metal cover (29) is employed, the distance (31) is preferably less than 4 times the passageway diameter (21) to prevent air entrainment into the turbulent stream. It is most preferably between 0 and −0.5 times the length (22) of the porous wall (15). A negative distance (31) is a distance the nozzle entered into the passageway, measured from the entrance end of the passageway to the nozzle opening.

The nozzle stand off distance (33), i.e., a distance between the opening of the nozzle (11) and the substrate, was about 6 inches. This provides the effective thermal properties of the turbulent stream when it strikes the target or substrate (5). Other nozzle standoff distance (33), however, can be used. This is an improvement over the coaxial shielding technology shown in U.S. Pat. No. 3,470,347, which is normally limited to a stand off distance of about 4 inches. The shield gas flow rate was about 3,000 ncfh of nitrogen. This gave an oxygen level measured at the substrate (15) of less than about 0.01%. This flow rate gives a low oxygen level at the target and gives suitable low oxide levels in the deposit. The flow rate of the shielding gas is normally proportional to the nozzle stand off distance (33) or to the turbulent stream flow.

A surprising feature of this invention is that reduced oxide deposits can be obtained even when the shield gas flow rate is lower than what is required to get low oxygen levels at the substrate. When the flow rate was reduced to 500 cfh, the oxygen level at the substrate was about 10%. A nickel deposit, however, had reduced oxide levels as evidenced by easy machining. When the shielding gas was turned off, the nickel deposit had high oxide levels as evidenced by difficult to machining. It appears that the shield gas is preferentially entrained into the turbulent stream near the orifice where the temperature is highest and oxidation most rapid. If the flow rate is less than that required to get a low oxygen level in the gas at the substrate, then the metal cover (29) is preferentially employed to insure that the shield gas is entrained in the initial portion of the turbulent stream. High purity nitrogen (less than 10 ppm impurities) was used for the shield gas. Any shield gas suitable to the process can be used. A preferred shield gas is a flammable mixture with a flame ignited at the interface between the shield gas and the ambient air. This flame stabilizes the flow and allows for plenum standoff distances (23) to be greater than 4 times the passageway diameter (21). A preferred gas composition for high vapor pressure metals is a mixture containing controlled levels of oxidizing gases such as O2, CO2 and H2O. The total oxidizing potential of the mixture is less than that of air. The controlled oxidation level reduces the vapor pressure of the metals without forming excessive oxides. Zinc, magnesium and iron are three metals that have significant vapor pressures near their melting points.

EXAMPLE 2

A shielding process was carried out using the shielding system illustrated in FIG. 1. The conditions were the same as example 1 except for the following conditions: A nitrogen jet flow rate from a nozzle having an orifice diameter of about 0.25 inch is about 200 ncfh at room temperature; a nitrogen shielding gas flow rate is about 250 ncfh; the passageway formed by a porous surface has a diameter of about 1⅞ inches and a length of about 2 inches; and the distance between a metal cover or other sealing means (29) and the closest end of the plenum (13) is about 0 inch. The experiment was repeated using the same conditions except that the nitrogen shielding gas was heated to about 540° F. before it was introduced into the plenum (13). The following Table illustrates the oxygen levels at various nozzle standoff distances (6) and at various nitrogen shielding gas temperature.

TABLE I

| Nozzle Standoff Inches | 02% at 70 deg F. Shield Gas | 02% at 540 Deg F. Shield Gas |
|---|---|---|
| 2 | <0.01 | <0.01 |
| 2.94 | 1.25 | <0.01 |
| 3.88 | 4.5 | 0.8 |
| 4.81 | 7.5 | 4 |
| 5.75 | 10 | 7.8 |

The results illustrates that a longer nozzle standoff distance can be achieved by heating a shielding gas. Heating the shielding gas to 540° F. increased the 1% O2 standoff distance from 2.94 inches to 3.88 inches. This is an increase of about 32%. A further increase is possible when additional shielding fluid or gas is provided coaxially with respect to the turbulent stream. The additional shielding fluid flow is preferably laminar.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A process for shielding a fluid containing stream from its surrounding environment, said process comprising:

(a) ejecting a turbulent flow of said fluid containing stream from at least one opening;

(b) emitting a laminar flow of a substantially inert shielding fluid transversely to the flowing direction of said turbulent flow of said fluid containing stream; and (c) entraining said transversely flowing shielding fluid in said turbulent flow of said fluid containing stream to prevent infiltration of gas and/or vapor from said fluid containing stream's surrounding environment.

2. The process according to claim 1, further comprising heating or combusting said fluid containing stream before it is ejected to produce said turbulent flow and introducing powder into said turbulent flow of said fluid containing stream.

3. The process according to claim 2, further comprising directing said turbulent flow of said fluid containing stream at a substrate and depositing said powder on said substrate.

4. The process according to Claim 1, further comprising heating said shielding fluid before it is emitted.

5. The process according to claim 1 wherein said laminar flow of with shielding fluid is emitted from a porous diffusing surface and surrounds at least a portion of a length of said turbulent flow of said fluid containing stream.

6. The process according to claim 5, wherein said porous diffusing surface has pores having a diameter in the range of about 0.2 to about 100 microns.

7. The process according to claim 5, wherein said porous diffusing surface defines a cylindrical passageway for passing said turbulent flow of said stream therethrough so that said laminar flow of said shielding fluid flows transversely to said turbulent flow of said stream.

8. The process according to claim 5, wherein said porous diffusing surface defines a diverging conical passageway for passing said turbulent flow of said stream therethrough so that said shielding fluid flows transversely to the turbulent flow of said stream.

9. The process according to claim 8, wherein said turbulent flow of said fluid containing stream is ejected at an angle in the range of about 0° to about ±70°, measured from the axis of said conical passageway.

10. The process according to claim 1, wherein said turbulent stream is an electric arc stream, a plasma arc stream or a flame.

11. The process according to claim 7, further comprising emitting a laminar flow of additional shielding fluid within said cylindrical passageway coaxially to said turbulent flow of said fluid containing stream.

12. The process according to claim 5, wherein the porosity of said porous diffusing surface is sufficient to provide a pressure drop of about 1 to about 10 psig with the shielding gas flowing.

13. The process according to claim 7, wherein said porous diffusing surface defines a cylindrical passageway having a length equal to at least ¼ the radius of said cylindrical passageway.

14. The process according to claim 5, further including a screen mounted over said porous diffusing surface to protect said diffusing surface from splatter from said fluid containing stream.

15. The process according to claim 1, wherein said turbulent flow is a spray of liquid droplets or solid particles.

16. The process according to claim 7, wherein said turbulent flow of said fluid containing stream is ejected at an angle of about 0° to about ±70°, measured from the axis of said cylindrical passageway.

17. The process according to claim 1, wherein said turbulent flow with entrained shielding fluid contains a reactive gas level of no more than 5 percent by volume at a point of impact.

18. The process according to claim 1, wherein said turbulent flow with entrained shielding fluid contains a reactive gas level of less than 1 percent by volume at a point of impact on a surface of a substrate to be coated.

19. The process according to claim 1, wherein said turbulent flow with entrained shielding fluid contains a reactive gas level of less than 0.01 percent by volume at a point of impact on a surface of a substrate to be coated.

* * * * *